United States Patent [19]

Harbison et al.

[11] Patent Number: 4,679,991

[45] Date of Patent: Jul. 14, 1987

[54] SUBMERSIBLE PUMP AND WASTEWATER BASIN APPARATUS

[75] Inventors: Joe A. Harbison, Gladstone, Mo.; Nyle D. LaGrange; Darryl M. Nielsen, both of Lenexa, Kans.

[73] Assignee: The Marley-Wylain Company, Mission Woods, Kans.

[21] Appl. No.: 820,692

[22] Filed: Jan. 21, 1986

[51] Int. Cl.[4] ..... F04B 17/00; F04B 35/00

[52] U.S. Cl. ..... 417/360; 417/361; 285/325

[58] Field of Search ..... 417/360, 361; 415/126, 415/201; 285/325, 326, 327, 24; 166/68.5, 85, 88; 222/180; 138/106, 109; 248/80, 87

[56] References Cited

U.S. PATENT DOCUMENTS

| | | | |
|---|---|---|---|
| 2,870,863 | 1/1959 | Bramhall | 285/325 |
| 3,018,925 | 1/1962 | Englesson | 417/360 |
| 3,234,885 | 2/1966 | Englesson | 415/126 |
| 3,515,495 | 6/1970 | Blum | 415/126 |
| 3,592,564 | 7/1971 | Conery | 417/360 |
| 3,635,606 | 1/1972 | Blum | 417/360 |
| 3,771,914 | 11/1973 | Crespo | 417/360 |
| 3,797,970 | 3/1974 | Blum | 417/360 |
| 3,851,898 | 12/1974 | Ihara | 285/24 |
| 4,060,345 | 11/1977 | Blum | 417/360 |
| 4,308,000 | 12/1981 | Oakes | 417/360 |

FOREIGN PATENT DOCUMENTS

| | | | |
|---|---|---|---|
| 858927 | 1/1961 | United Kingdom | 285/325 |

*Primary Examiner*—Carlton R. Croyle
*Assistant Examiner*—Donald E. Stout
*Attorney, Agent, or Firm*—Schmidt, Johnson, Hovey & Williams

[57] ABSTRACT

A tank mounted discharge conduit assembly for use with a submersible pump unit comprises a base member connected to the tank as well as an upright body having a fluid conduit therein. The base member has an upwardly extending portion which is complementally received within a lower portion of the upright body, in order to provide support against lateral deflection of the body as well as to prohibit the flow of fluids through a lower end of the conduit. The body also integrally includes a pair of upright, spaced, elongated, U-shaped guides which are configured to slidably receive an outlet flange of the pump and shift the latter toward a position of fluid communication between the pump and an opening in the body communicating with the fluid conduit therein. The guides advantageously include yieldable wall portions which accommodate lateral movements of the pump unit to facilitate raising and lowering of the pump by a rope-equipped hoist when the latter is unintentionally vertically misaligned with the center of gravity of the pump unit.

11 Claims, 7 Drawing Figures

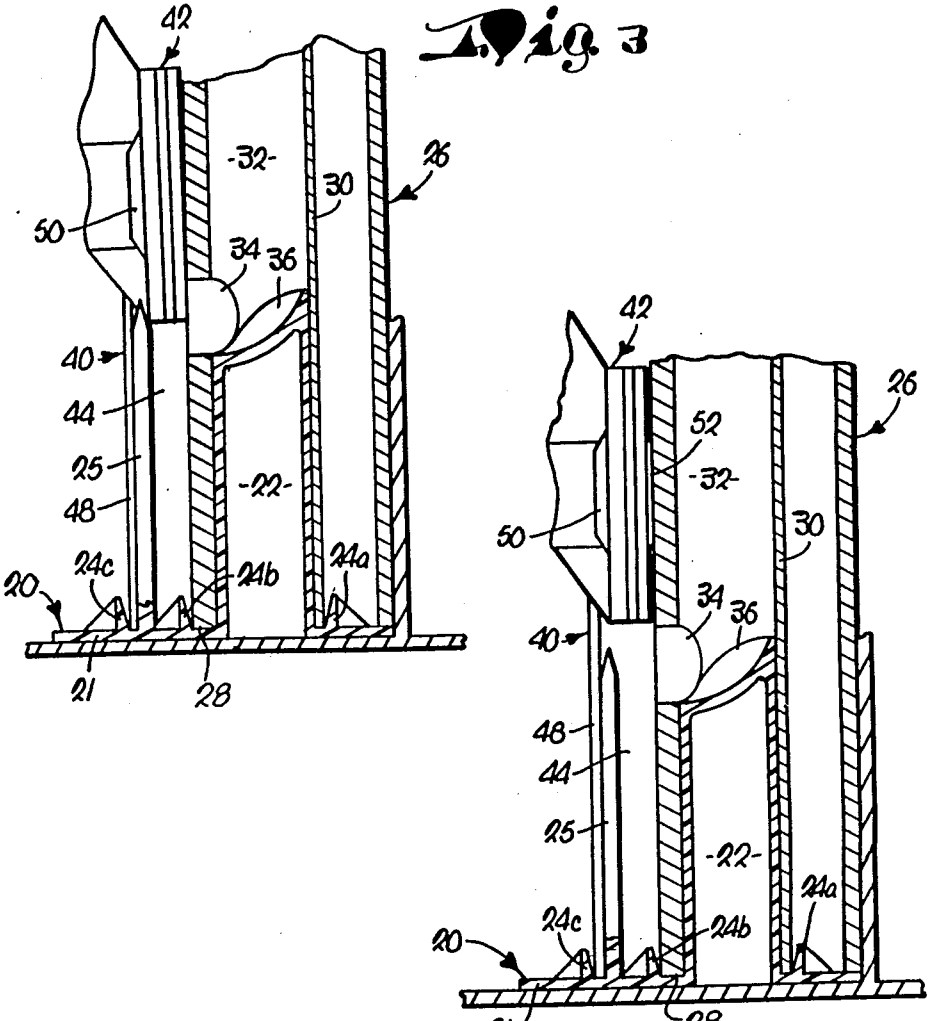
Fig. 2
Fig. 3
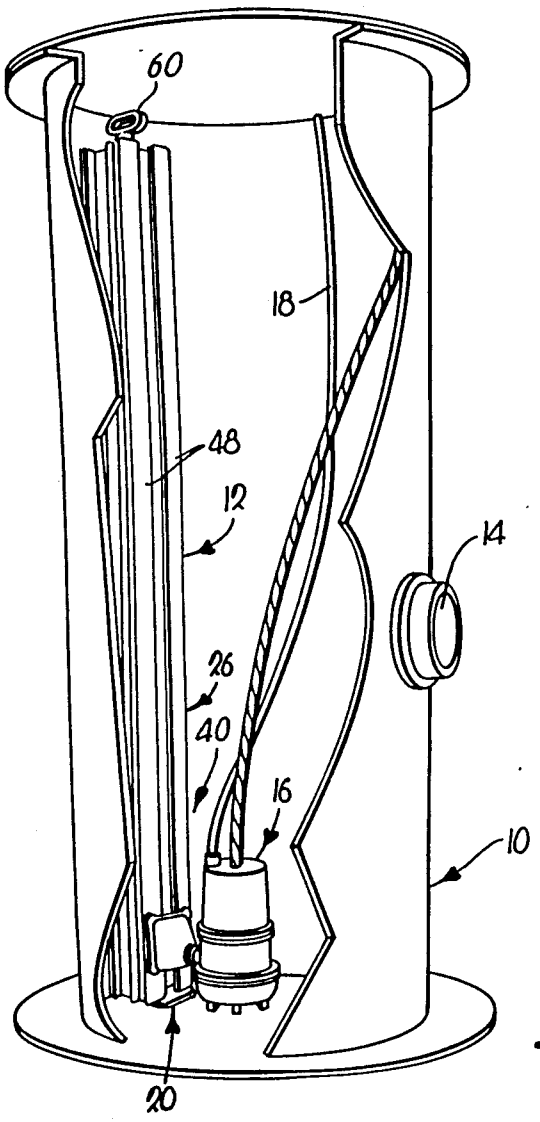
Fig. 1

SUBMERSIBLE PUMP AND WASTEWATER BASIN APPARATUS

BACKGROUND OF THE INVENTION

1. Field of the Invention

This invention relates to a combined guide structure and discharge conduit for a submersible pump vertically shiftable between a lower, operating position and an upper position for maintenance. The guide structure comprises an integral pair of spaced, upright, U-shaped guides which slidably capture an outlet flange of the pump and the guides include flexible wall portions to accommodate movements of the pump flange in a direction laterally of the longitudinal axis of the guides.

2. Description of the Prior Art

Submersible pump systems are widely used in a variety of applications such as low pressure wastewater systems wherein the pump is installed within a subgrade tank for pumping effluent to overlying gravity pipes or secondary treatment facilities. Although submersible pumps are designed to operate reliably over extended periods of time, there are nevertheless occasions where the pump must be removed from the tank for servicing. As can be appreciated, it is thus greatly preferable to provide a means for enabling a worker to lift the pump from the tank without bodily descending into the latter.

Consequently, a variety of guide structures and rail systems for submersible pumps have been proposed in the past. Desirably, the guide structure should cause the pump to be readily lowered into the medium to be pumped and also effect a secure and tight coupling between the pump outlet and a discharge conduit typically fixed within a lower portion of the tank. At the same time, the guide structure should facilitate disconnection of the pump outlet from the discharge conduit and enable lifting of the pump for subsequent removal and servicing. Preferably, the guide structure of larger pumping systems should accommodate the use of a rope and hoist to prevent muscular strain.

One example of a submersible pump assemblage is shown in U.S. Pat. No. 3,515,495 to Blum, wherein an outlet flange of a pump unit slidably engages a pair of opposed, U-shaped, upright channels which guide the pump toward a position adjacent a discharge pipe. A somewhat similar concept is shown in U.S. Pat. No. 3,851,898 to Ihara.

However, known submersible pump guide systems are constructed from a multiplicity of components which each must be positioned relative to each other and fixed to the tank in order to provide secure and precise positioning of the pump in its lowermost, operational disposition in communication with a discharge conduit. Furthermore, past guide structures do not generally accommodate lateral movement of the pump during lifting and consequently a hoist, if used, must be properly oriented with respect to the pump's center of gravity to facilitate true, vertical lifting of the pump without binding of the latter against the guide structure.

SUMMARY OF THE INVENTION

The present invention overcomes the above noted disadvantages of prior art submersible pump systems by provision of a guide structure which accommodates lateral movement of the pump during raising or lowering of the same. Moreover, the guide structure is integrally formed with a fluid conduit for receiving effluent discharged by the pump, and is secured against lateral movement by means of an upstanding base member secured to the tank and complementally configured to plug a lower, unused portion of the fluid conduit.

In more detail, the guide structure comprises an integral pair of upright, spaced, U-shaped guides which combine to define an elongated, transversely rectangular channel for slidably receiving an outlet flange of the pump. One wall portion of each of the extruded U-shaped guides is yieldable for accommodating movement of the pump flange in a direction generally laterally of the longitudinal axis of the channel. As a result, the pump can be freely lifted even when connected to a hoist which is not vertically aligned with the center of gravity of the pump.

In preferred forms, the outlet flange of the pump is provided with an outwardly extending tab slidably engageable with the yieldable guide wall portions for facilitating sliding movement therealong. Additionally, an arm adjacent a lower portion of the guide is operable to shift the outlet flange into a position of sealing relationship with walls adjacent an opening communicating with the discharge conduit.

The upwardly extending portion of the base member which is received within the fluid conduit is complemental in configuration to the latter to thereby provide support against lateral deflection of the guides as well as the conduit walls. The base member portion includes a curved surface positioned adjacent the opening for guiding the flow of fluids from the opening, through a 90° turn and subsequently along the longitudinal axis of the conduit. At the same time, the base member portion functions to plug a lowermost end of the conduit so that the latter may be cut to any desired length without the necessity, for example, of threading the conduit end and attaching an elbow connector.

Optionally, a plunger valve is disposed in an upper portion of the conduit and a laterally extending port adjacent the valve is operable to receive the flow of fluid from the conduit whenever the valve is open. A portion of the conduit above the valve and unused for fluid passage can thereby receive a handle extension for the valve and provide support for the latter, avoiding the need for handle guides or other hardware. Consequently, the simplified, extruded conduit assembly of the instant invention represents an inexpensive yet significant solution to the problems associated with prior art systems.

BRIEF DESCRIPTION OF THE DRAWINGS

FIG. 1 is a side elevational view with parts broken away for clarity showing an upstanding tank containing a submersible pump system of the present invention;

FIG. 2 is an enlarged, fragmentary, side sectional view of an upright body and base member of the pump system of FIG. 1 wherein a pump outlet flange is elevated with respect to an opening of a discharge conduit with the upright body;

FIG. 3 is a fragmentary, enlarged, side sectional view similar to FIG. 2 wherein arms of the base member engage the flange for shifting the latter as the pump is moved toward a lowermost, operating position;

DETAILED DESCRIPTION OF THE DRAWINGS

Figure 4:
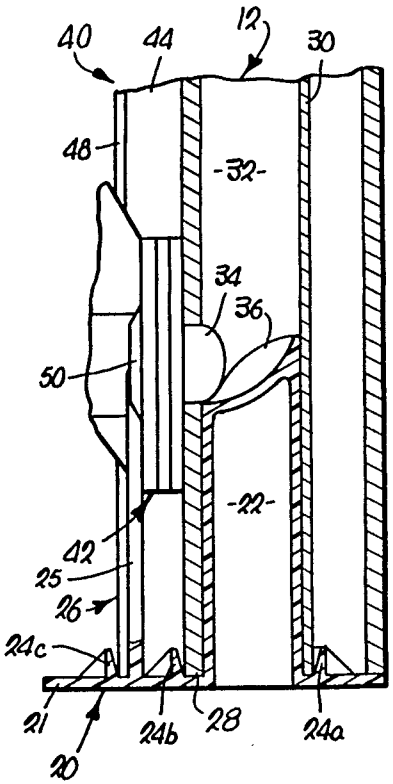
FIG. 4 is a fragmentary, enlarged, side sectional view similar to FIG. 3 wherein the pump outlet flange is positioned adjacent an opening of the body for pumping fluids to the discharge conduit.
Figure 5:
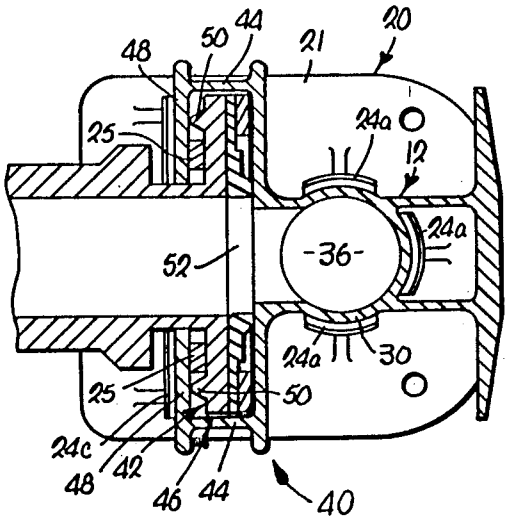
FIG. 5 is an enlarged, fragmentary, horizontal sectional view of the pump system of the present invention wherein the outlet flange is disposed in its operating position as illustrated in FIG. 4.

As shown in FIG. 1, a fluid discharge conduit assembly 12 is mounted within an upstanding tank 10 optionally comprised of fiberglass. The tank 10 has an inlet 14 for admitting wastewater to the tank 10, and a submersible pump unit 16, receiving power from an electric cord 18, is operable to pump fluids from the tank 10 and through the discharge conduit 12 toward a remote location.

More specifically, as illustrated in FIGS. 2–7, the discharge conduit assembly 12 has a base member 20 which advantageously may be integrally molded to the bottom of the tank 10. The base member 20 includes a flat base plate 21, an upwardly extending cylindrical portion 22, a series of relatively short ribs 24*a*, 24*b* and 24*c*, and a pair of upstanding arms 25, 25 for purposes to be explained hereinafter.

The conduit assembly 12 additionally includes an upright, elongated, extruded body 26 having a lowermost end 28. The body 26 has elongated walls 30 defining a vertically oriented, cylindrical fluid conduit 32 which extends through the body 26 as well as through the lower body end 28. Moreover, the body 26 has an opening 34 (FIGS. 2–5) spaced from the lower end 28 and extending transversely through the walls 30 such that the opening 34 is in communication with the fluid conduit 32.

The transverse cross-section of the base member upwardly extending portion 22 is complemental in configuration to the transverse cross-section of the fluid conduit 32. Thus, the fixed connection between the base member 20 and the tank 10 enables the upwardly extending portion 22 to thereby provide support against lateral deflection of the upright body 26. Also, the ribs 24*a*–24*c* complementally engage the walls 30 as a distance spaced from the conduit 32 to additionally laterally support the body 26 and facilitate orientation of the base member 20 relative to the body 26 during assembly.

Moreover, the base member portion 22, being complemental to the fluid conduit 32, is therefore operable as a plug to generally prohibit the flow of fluids through a lower portion of the conduit 32 adjacent the end 28. An upper curved surface 36 of the outwardly extending portion 22 advantageously guides the flow of fluids from the opening 34, through a 90° turn and thence upwardly through the conduit 32.

The body 26 also includes structure 40 adapted to support an outlet flange 42 of the pump unit 16 in adjacent relationship to the opening 34 to thereby establish a fluid flow path between the pump unit 16, through the opening 34 and to the conduit 32 (see FIGS. 2–4). The structure 40, as shown best in FIGS. 5–6, includes an integral pair of upright, elongaged, spaced, generally U-shaped guides 44, 44 which define an upright, elongated, transversely rectangular channel 46 for slidably receiving the outlet flange 42. The guides 44, 44 are preferably integrally molded with the walls 30, and the guides 44, 44 each have yieldable wall portions 48, 48 for accommodating movement of the outlet flange 42 in a direction generally laterally of the longitudinal axis of the channel 46.

Figure 6:
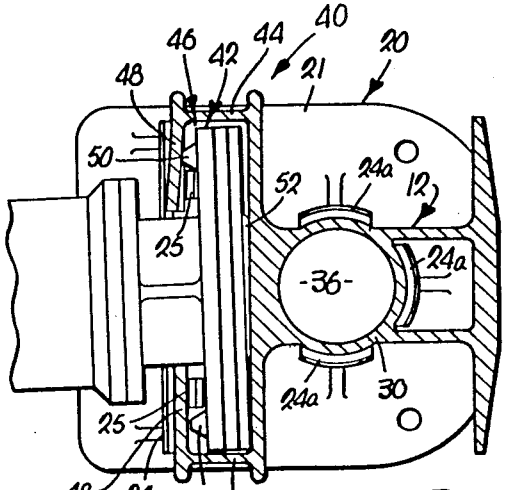
FIG. 6 is an enlarged, fragmentary, horizontal sectional view similar to FIG. 5 wherein yieldable wall portions of guide structure for the pump unit have flexed to accommodate lateral movement of the outlet flange as the pump unit is raised or lowered.

In preferred forms of the invention, the pump outlet flange 42 is provided on opposite sides with vertically elongated, horizontally extending tabs 50, 50 which are engageable with the respective guides 44, 44 for facilitating sliding movements of the flange 42 along the guides 44, 44. The anti-binding tabs 50, 50 function to decrease the total amount of frictional resistance to sliding movement by decreasing the area of contact of the flange 42 with the guides 44, 44 such that only two small areas of contact are normally provided. Referring to FIG. 2, when the pump unit 16 is in a position above the opening 34, the tabs 50, 50 are engageable with the yieldable wall portions 48, 48 respectively. During lateral movement of the pump unit 16 in a direction transverse to the longitudinal axis of the body 26, one of the tabs 50 can shift the respective wall portion 48 outwardly, as seen in FIG. 6, without causing undue binding of the flange 42 within the channel 46. At the same time, the inherent resiliency of the extruded wall portion 48 biases the flange 42 toward a position of alignment with the channel 46.

As the pump unit 16 is lowered toward an operating disposition adjacent the opening 34, the upwardly extending arms 25, 25 of the base member 20 engage the outlet flange 42, as illustrated in FIG. 3. Thereafter, as the pump unit 16 continues to be lowered, the arms 25, 25 function to shift the flange laterally so that a hydraulic seal 52 (see FIG. 5) is brought into generally sealing relationship with the walls 30 surrounding the opening 34. Optionally, the seal 52 may have an annular inner portion adapted to be forced against the walls 30 when the pump unit 16 is in operation, in similar fashion to the hydraulic seal shown in U.S. Pat. No. 3,592,564 owned by the assignee of the instant invention. However, even when the pump unit 16 is inactive, it is desirable that the seal 52 establish a fluid tight relationship with the walls 30 in order to prevent a reverse flow of fluids from the conduit 32 back into the tank 10.

Figure 7:
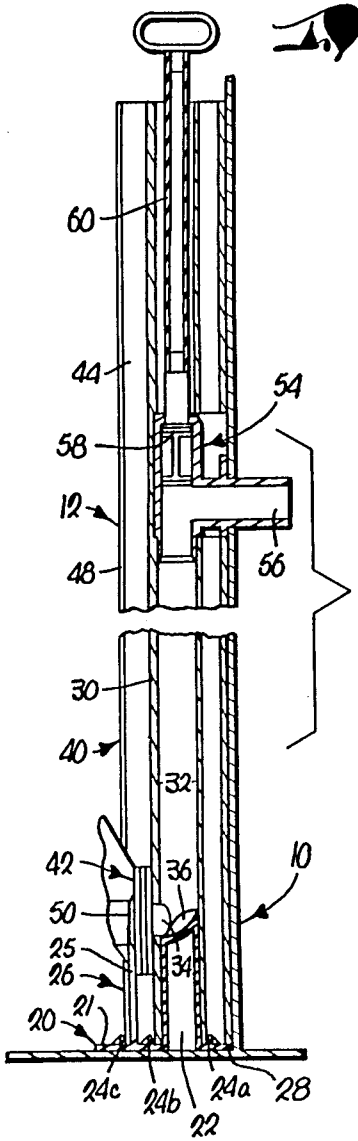
FIG. 7 is an enlarged, fragmentary, side sectional view of the pump system shown in FIG. 1 showing the disposition of a plunger valve and an associated handle extension within the fluid conduit.

Viewing FIG. 7, a plunger valve 54 is slidably disposed in an upper portion of the fluid conduit 32 and is shiftable between a closed position and an open position wherein the fluid conduit 30 is in communication with a transversely extending outlet port 56. The plunger valve 54 includes two O-rings 58 for generally precluding the flow of fluids into the portion of the conduit 32 above the valve 54 and back into tank 10 when the valve 54 is in the closed position. As can be seen, the remaining segment of the conduit 32 overlying the valve 54 thus functions as a passageway for supporting a handle extension 60 that is coupled to the plunger valve 54, so that the use of external supports or guides for the handle extension 60 is thereby avoided.

As can now be appreciated by those skilled in the art, the upstanding body 26, in cooperation with the base member 20, provide both a discharge passageway for fluid pumped from the tank 10 as well as structure for guiding the pump unit 16 between a lowered, operating position and a raised position for maintenance. The complemental reception of the base member portion 22 within the fluid conduit 32 enables the use of a simplified configuration of the body 26 so that the latter may be extruded and the necessity of providing a separate elbow connector at the lowermost end 28 of the conduit 32 is avoided. The base member 20 functions to plug the body end 28 as well as guide pumped fluid through the opening 34 and upwardly through the conduit 32. At the same time, the base member 20 provides a means for fixedly coupling the body 26 to the tank 10 without the need for brackets or other supports.

The yieldable wall portions 48 enable the pump unit 16 to be lifted with a minimum of frictional resistance by a chain or rope (FIG. 1) pulled by an appropriate hoist (not shown) when the latter is unintentional vertically misaligned with the center of gravity of the pump unit 16. Moreover, the tabs 50, 50 also decrease sliding resistance regardless of whether the yieldable wall portions 48 are flexed, as shown in FIG. 6, or whether the pump unit 16 is lowered or raised in alignment with the center of gravity of the latter, as depicted in Fig. 2.

We claim:

1. A tank mounted discharge conduit assembly for use with a submersible pump unit having an outlet flange comrising:

a base member connected to said tank; and an upright body having a lowermost end, said body having elongated walls defining a fluid conduit extending at least partially through said body and through said lowermost end, said body having an opening spaced from said end and extending transversely through said walls, said opening being in communication with said conduit, said base member having an upwardly extending portion complementally received in said conduit adjacent said lowermost end to thereby provide support against lateral deflection of said body, said body having structure adapted to support said outlet flange of said submersible pump unit in adjacent relation to said opening to thereby establish a fluid flow path from said pump unit, through said opening and to said conduit, said structure defining an elongated channel for slidably receiving said outlet flange, said structure including a pair of upright, spaced, U-shaped guides, said guides having yieldable wall portions for accommodating movement of said flange in a direction generally laterally of the longitudinal axis of said channel.

2. A tank mounted discharge conduit assembly for use with a submersible pump unit having an outlet flange comprising:

a base member connected to said tank; and an upright body having a lowermost end, said body having elongated walls defining a fluid conduit extending at least partially through said body and through said lowermost end, said body having an opening spaced from said end and extending transversely through said walls, said opening being in communication with said conduit, said base member having an upwardly extending portion complementally received in said conduit adjacent said lowermost end to thereby provide support against lateral deflection of said body, said body having structure adapted to support said outlet flange of said submersible pump unit in adjacent relation to said opening to thereby establish a fluid flow path from said pump unit, through said opening and to said conduit, said structure defining an elongated channel for slidably receiving said outlet flange, said base member having an arm adjacent said opening for shifting said flange into a position of generally sealing relationship with said walls adjacent said opening as said flange is moved along said channel toward said opening.

3. The invention as set forth in claim 2, wherein said outlet flange is provided with outwardly extending tabs slidably engageable with said structure for facilitating sliding movement of said flange along said channel.

4. The invention as set forth in claim 2, said base member portion includes a surface adjacent said opening for guiding the flow of fluids through said opening and said conduit.

5. The invention as set forth in claim 4, wherein said surface is curved.

6. The invention as set forth in claim 5, wherein said base member includes a plurality of outwardly extending ribs engageable with said body walls at a location spaced from said conduit to thereby provide additional support against lateral deflection of said body.

7. The invention as set forth in claim 2; including an outlet port in said body, said port communicating with said conduit in overlying relation to said opening; and a plunger valve disposed in said conduit adjacent said outlet port, said valve including a handle extension received in said conduit.

8. A submersible pump system comprising:

a pump unit selectively shiftable along an upright axis and having an outlet surrounded by a flange;

a discharge conduit having walls defining an opening adapted to receive a flow of fluid from said pump unit; and structure for guiding said pump unit outlet flange into a location adjacent said opening walls as said pump unit is shifted along said upright axis such that said outlet of said pump unit is positioned for directing fluids into said opening, said structure having an upright wall portion slidably engageable with said pump unit during at least a portion of the time that said pump unit is shifted along said axis, said wall portion being yieldable in directions transverse to said upright axis to accommodate movements of said pump unit laterally of said axis, said wall portion being resilient for biasing said pump unit toward a certain aligned orientation relative to said axis subsequent to yielding of said wall portion to facilitate shifting of said pump unit along said upright axis toward said location adjacent said discharge conduit opening walls.

9. The invention as set forth in claim 8, wherein said wall portion comprises a portion of an elongated, upstanding, tranversely U-shaped guide.

10. The invention as set forth in claim 9, wherein said pump outlet flange is slidably received in said guide.

11. The invention as set forth in claim 10, wherein said pump outlet flange is provided with an outwardly extending tab slidably engageable with said guide for facilitating sliding movement of said outlet flange along said guide.

* * * * *